US007607545B2

(12) United States Patent
Daniel

(10) Patent No.: US 7,607,545 B2
(45) Date of Patent: Oct. 27, 2009

(54) SYSTEM AND METHOD FOR INSPECTING AND SORTING MOLDED CONTAINERS

(75) Inventor: Benjamin L. Daniel, Bellevue, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 802 days.

(21) Appl. No.: 10/970,312

(22) Filed: Oct. 20, 2004

(65) Prior Publication Data

US 2006/0081512 A1 Apr. 20, 2006

(51) Int. Cl.
*B07C 5/00* (2006.01)

(52) U.S. Cl. ..... 209/523; 65/29.12; 65/29.18

(58) Field of Classification Search ..... 209/522, 209/523; 65/29.12, 29.14, 29.18, 158, 160
See application file for complete search history.

(56) References Cited

U.S. PATENT DOCUMENTS 3,378,138 A 4/1968 Brown
3,656,616 A 4/1972 Wallington
3,745,314 A 7/1973 Mathias et al
3,923,158 A 12/1975 Fornaa
3,963,918 A 6/1976 Jensen et al.
4,047,000 A 9/1977 Bryant et al.
4,109,511 A * 8/1978 Powers et al. ..... 73/37.6
4,175,236 A 11/1979 Juvinall
4,230,219 A 10/1980 Pezzin et al.
4,230,266 A 10/1980 Juvinall
4,244,650 A 1/1981 Garfunkel et al.
4,332,606 A 6/1982 Gardner
4,413,738 A * 11/1983 Pemberton et al. ..... 209/523
4,431,436 A 2/1984 Lulejian
4,639,263 A 1/1987 Kulikauskas
4,644,151 A 2/1987 Juvinall
4,691,830 A * 9/1987 Ahl et al. ..... 209/523
4,762,544 A * 8/1988 Davey ..... 65/29.11
4,832,181 A 5/1989 Rugab et al.
4,965,523 A 10/1990 Baker et al.
4,967,070 A 10/1990 Ringlien et al.
4,996,658 A 2/1991 Baker
5,166,874 A 11/1992 Nomaru et al.
5,392,928 A 2/1995 Nickey et al.
5,675,516 A * 10/1997 Bone et al. ..... 702/104

(Continued)

FOREIGN PATENT DOCUMENTS

EP 0 088 914 A1 9/1983

(Continued)

*Primary Examiner*—Patrick H Mackey
*Assistant Examiner*—Mark Hageman

(57) ABSTRACT

An apparatus and method for inspecting and sorting molded containers includes an inspection device for inspecting containers and a container mold of origin identifier for correlating a container that is determined to have at least one unacceptable commercial variation with the mold cavity that produced the container. A controller having a programmed cavity reject threshold is in communication with the inspection device and the container mold of origin identifier for monitoring a commercial variation threshold to determine if a mold of origin has produced a threshold number of containers having a commercial variation outside the acceptable limits. A diverter is in communication with the controller for segregating all the containers produced by a mold of origin determined to have produced the threshold number of containers having the commercial variation beyond the acceptable limits.

15 Claims, 2 Drawing Sheets

U.S. PATENT DOCUMENTS

| | | | | |
|---|---|---|---|---|
| 5,926,556 | A | 7/1999 | Douglas et al. | |
| 5,935,285 | A | 8/1999 | Lucas | |
| 6,025,910 | A | 2/2000 | Lucas | |
| 6,296,123 | B1 | 10/2001 | Zakeri et al. | |
| 6,536,598 | B2 | 3/2003 | Furnas | |
| 6,584,805 | B1 * | 7/2003 | Burns et al. | 65/29.12 |

FOREIGN PATENT DOCUMENTS

| | | | |
|---|---|---|---|
| EP | 0 213 797 | A1 | 3/1987 |
| EP | 0277872 | | 8/1988 |
| EP | 0 409 071 | A2 | 1/1991 |
| EP | 0 635 315 | A2 | 1/1995 |
| EP | 1195336 | | 4/2002 |

* cited by examiner

SYSTEM AND METHOD FOR INSPECTING AND SORTING MOLDED CONTAINERS

FIELD OF THE INVENTION

This invention relates generally to the manufacture of articles of glassware, and more particularly to systems and methods for inspecting and controlling glassware production.

BACKGROUND OF THE INVENTION

In manufacturing of molded containers, such as glass bottles and jars, commercial variations are often related to variations in the associated molds of origin. For this reason, it is desirable in an automated manufacturing operation having a plurality of molds to identify a specific container with its mold of origin, and the associated commercial variations with molds of origin for repair or replacement of molds creating excessive non-compliant or non-commercial product. The term "commercial variations" refers to variations—e.g., dimensional variations that can affect the commercial acceptability of the containers.

Individual section (IS) machines typically include a plurality of mold cavities and automated apparatus for feeding glass gobs to successive molds to form the containers, such as through blow molding. The blown containers are then fed by suitable conveying apparatus to a lehr for annealing, and then to a so-called "cold end" where inspecting and sorting are performed prior to packaging the containers for shipment. Desirably, the packaged product is free from unacceptable commercial variations, such as may result through problems developed over time in the molds. When problems do result, particularly within the molds, it is desirable to detect the problems as quickly as possible so that the molds can be repaired or replaced to prevent the continued production of containers having unacceptable commercial variations.

SUMMARY OF THE INVENTION

A method of inspecting and sorting molded containers, in accordance with one aspect of the present invention, includes inspecting molded containers for commercial variations outside of acceptable limits, setting a cavity reject threshold for at least one unacceptable commercial variation, correlating a container that is determined to have at least one unacceptable commercial variation with the mold cavity that produced the container, and segregating all containers produced by a mold cavity after the mold cavity is determined to have produced a number of containers in excess of the set reject threshold for the unacceptable commercial variation.

In another aspect of the invention, a system for inspecting and sorting molded containers includes an inspection device that inspects containers to determine if a container has at least one commercial variation outside of the acceptable predetermined limits. In addition, the system has a container mold of origin identifier adapted to identify the mold of origin of a container determined to have at least one unacceptable commercial variation. Further, the system has a controller in communication with the inspection device and the container mold of origin identifier. The controller is operable to monitor at least one programmable commercial variation threshold to determine if a mold of origin has produced a threshold number of containers having a commercial variation outside of the acceptable limits. The system also includes a diverter in communication with the controller to segregate all the containers produced by a mold of origin determined to have produced the threshold number of containers having the commercial variation beyond the acceptable limits.

BRIEF DESCRIPTION OF THE DRAWINGS

These and other objects, features, advantages and aspects of the invention will become readily apparent in view of the following detailed description of the presently preferred embodiments and best mode, appended claims and accompanying drawings, in which:

DETAILED DESCRIPTION OF THE PREFERRED EMBODIMENTS

Figure 1:
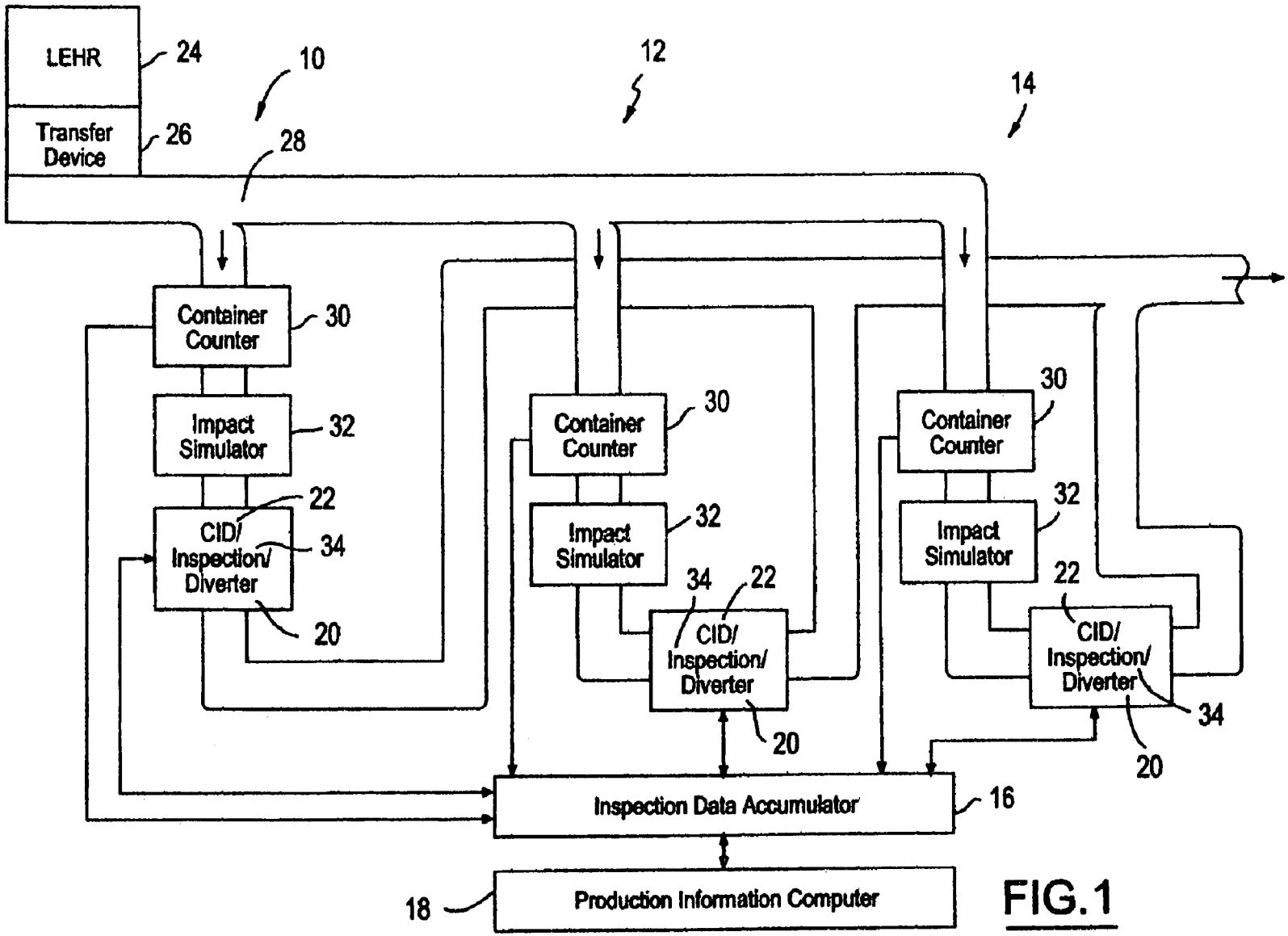
FIG. 1 is a schematic diagram illustrating a plurality of inspection lines incorporating a method and system for inspecting and sorting molded containers according to one presently preferred embodiment of the invention.

Referring in more detail to the drawings, FIG. 1 illustrates a plurality of inspection lines 10, 12, 14, such as those used to inspect blow molded containers, for example. The inspection lines 10, 12, 14 are primarily used to inspect various types of attributes or commercial variations of the containers and communicate the inspection data to an inspection data accumulator (IDA) 16. The IDA 16 is in two-way communication with a controller or production information computer (PIC) 18 that is programmable to establish the acceptable commercial variation threshold or upper and/or lower limits that need to be attained for the finished containers. The PIC 18 communicates via the IDA 16 back to the respective inspection line 10, 12, 14 to direct a diverter 20 in each line to either allow the finished product from the respective mold cavities to continue for further processing, or to segregate the containers from a specified mold cavity having commercial variations falling outside the preprogrammed acceptable limits. If the PIC 18 determines that a particular mold cavity is producing an unacceptable first ratio of acceptable versus unacceptable product, then the PIC 18 directs the diverter 20 to reject or segregate 100% of the subsequent product formed by the identified mold cavity, thereby rendering the mold cavity as a temporarily rejected mold cavity. Desirably, only after the rejected mold cavity produces a predetermined second ratio of acceptable versus unacceptable product does the PIC 18 automatically instruct the diverter 20 to allow the acceptable product from the previously rejected mold cavity to continue for further processing. The second ratio may be the same as or higher than the first ratio.

As containers are being formed in the production mold cavities, a unique identifying code is impressed into the bottom of every container, or otherwise encoded on the containers, as desired. The containers are then fed or directed to a lehr 24 in a predetermined sequence from the mold cavities. The lehr 24 tempers the glass through a predefined heating and cooling process to provide the containers with the desired strength and finish characteristics.

The containers are preferably removed from the lehr 24 by a transfer device 26 and then placed on a conveyor 28 for sequentially conveying the containers to the inspection lines 10, 12, 14. Any number of inspection lines can be used to increase or decrease the capacity for product flow, or a single inspection line could be used, as desired. Upon entering the inspection lines 10, 12, 14, the containers preferably pass through a container counter 30, such as a photoelectric eye, for example, which communicates the number of containers passing thereby to the IDA 16, which in turn communicates with the PIC 18. Thereafter, the containers preferably pass through an impact simulator 32 to test for structural commercial variations, principally in the side wall surfaces thereof, generally by applying pressure to a portion of the circumference of the side walls of the containers.

Thereafter, the containers passing through the impact simulator 32 without being rejected or broken are conveyed through an apparatus that includes a container mold-of-origin identifier or cavity identifying device CID 22, diverter 20 and a finish product (FP) machine 34, wherein the FP machine 34 desirably includes various types of inspection devices. Suitable FP machines are disclosed, for example, U.S. Pat. Nos. 4,378,493 and 6,581,751. The CID 22 can correlate each container with its mold of origin by reading the unique identifying code on the container, such as discussed in U.S. Pat. No. 4,644,851, which is assigned to the applicant herein and incorporated herein by reference in its entirety. At the same time, the FP machine 34 inspects the container for any number of commercial variations, such as by way of example and without limitation, variations in diameter, height, level of finish around the periphery thereof, commonly known as warp and dip and cocked finish, and vertical and horizontal checks in the finish, as desired. The mold of origin information and the inspection information are communicated to the IDA 16, and thus, to the PIC 18.

The PIC 18 utilizes the information received from the counter 30, CID 22 and FP machine 34 to monitor at least one predefined programmable threshold, wherein the threshold typically includes upper and/or lower limits for at least one of the commercial variations that can be produced by the mold cavities. As such, the PIC 18 determines if any one of the molds of origin is producing containers having at least one of the commercial variations outside the acceptable threshold limits, and further determines if the mold of origin is producing unacceptable containers in excess of a predefined acceptance ratio of acceptable to unacceptable containers. If the PIC 18 determines that any one (or more) of the mold cavities is producing unacceptable containers in excess of the predefined acceptance ratio, the PIC 18 sends a signal back to the respective diverter 20 to segregate and/or remove 100% of the containers formed by the identified mold cavity.

Figure 2:
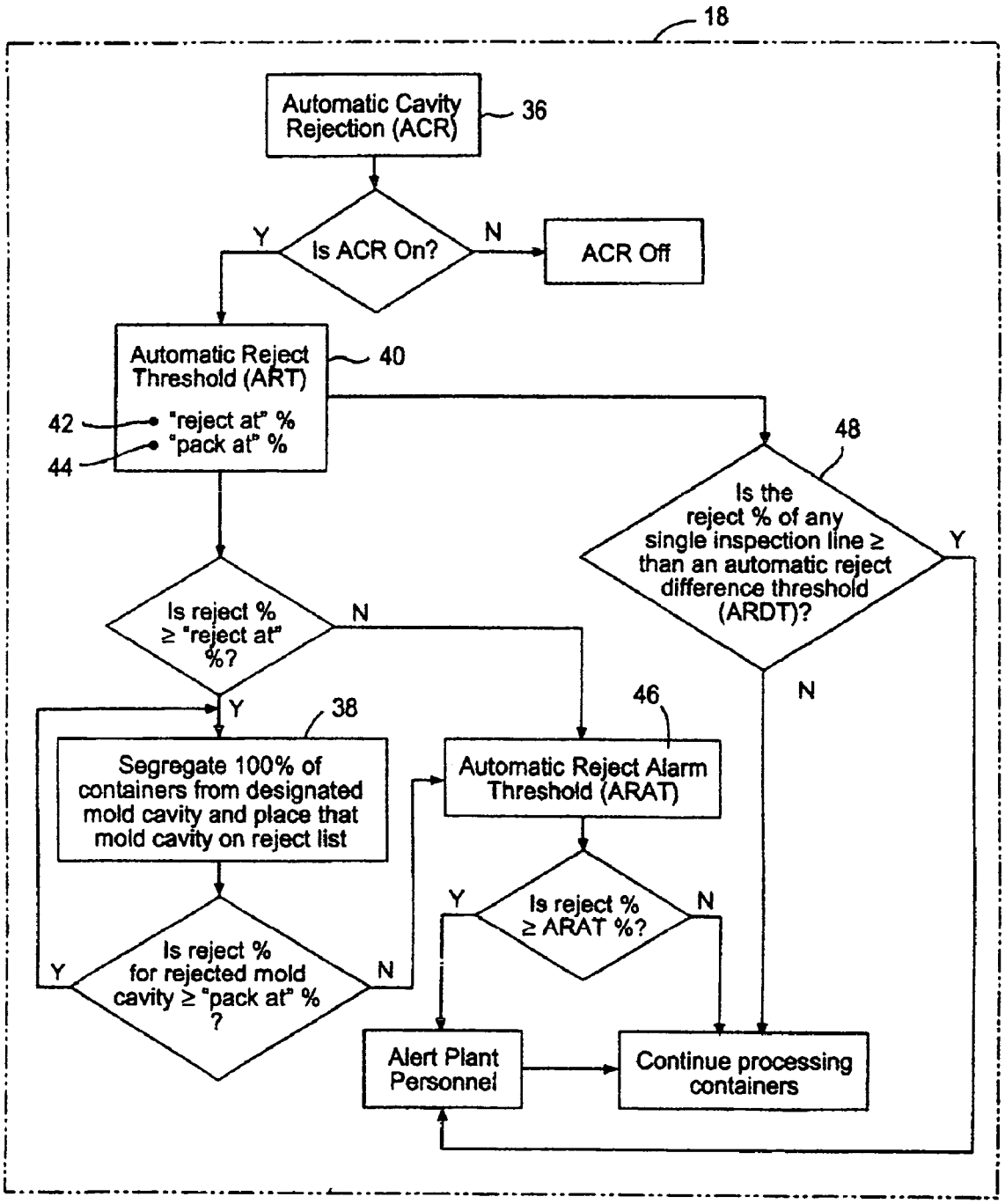
FIG. 2 is a process flow diagram for a controller used in the method and system for inspecting and sorting molded containers.

As shown schematically in FIG. 2, the PIC 18 can be programmed to account for any number of commercial variations separately from one another or in consideration of one another, as desired, to facilitate packaging containers falling within the predefined acceptable limits and segregating out those that fall outside the predefined acceptable limits. The segregated containers can be held for re-inspection and/or further consideration of continued processing and inspection, or they can be removed from the respective production line 10, 12, 14 thereby rendering them as unacceptable and not suitable for packaging, as desired. The PIC 18 incorporates an automatic cavity rejection (ACR) 36 feature that, when enabled, provides the PIC 18 with the ability to automatically add a single identified mold cavity from an IS machine to a reject list 38, and potentially reject the containers produced by the identified mold cavity without affecting the ability of the remaining mold cavities from the IS machine from producing acceptable containers for further processing. Therefore, the ACR 36 allows for targeted segregation of unacceptable containers traveling along at least one of the production lines 10, 12, 14 without segregating an entire lot from the IS machine.

In order for the PIC 18 to determine if one or more of the mold cavities should be added to the reject list 38, a cavity reject threshold is programmed into the PIC 18, such as by plant personnel, preferably as a predetermined percentage for an unacceptable commercial variation, referred to hereafter as an automatic reject threshold (ART) 40. The ART 40 may be programmed for any number of commercial variations, and may include different predetermined thresholds for each commercial variation, as desired. The ART 40 has a cavity first or "reject at" threshold 42 and a cavity second or "pack at" threshold 44. The "reject at" threshold 42 is the ratio of unacceptable containers at which one of the cavities is automatically placed on the reject list 38. This ratio is generally calculated as a percentage of unacceptable containers produced by any single mold cavity verses the total number of containers produced by the same mold cavity over a predetermined amount of time, such as ten minutes, for example. As such, preferably, the PIC 18 will not place a mold cavity on the automatic reject list 38 until some preprogrammed number of containers from the identified mold cavity are inspected. The "pack at" threshold 44 is the ratio of unacceptable containers for automatically removing the cavity from the reject list 38 for the specified commercial variation for which it was automatically rejected.

For example, if a commercial variation, such as "out-of-round" for example, has a "reject at" threshold set at ten percent, and the PIC 18, upon receiving inspection information from the FP machine 34 over the predefined amount of time, shows that ten percent or more of the containers produced by a particular mold cavity do not pass the out-of-round inspection, then the responsible mold cavity will be automatically placed on the automatic reject list 38. Accordingly, a signal is sent from the PIC 18 to the diverter 20 to segregate 100% of the containers produced by the identified mold cavity. Thereafter, the mold cavity will remain on the automatic reject list 38 until it is determined that the percentage of unacceptable containers produced by the responsible mold cavity for the commercial variation for which it was originally automatically rejected falls below the "pack at" threshold 44, which is typically set as a reduced percentage from the "reject at" threshold 42, such as 8 percent, for example. Preferably, once a particular mold cavity is automatically removed from the reject list 38, the mold cavity will not be subject to another automatic rejection until a new batch of containers from a subsequent lehr operation is inspected. Otherwise, in order for the mold cavity to be removed from the automatic reject list 38, plant personnel may manually override the ACR 36 system. Desirably the system will indicate when a manual override has occurred, such as through a visual display on a monitor of the PIC 18 for example, and that the containers continuing for further processing from the previously rejected mold cavity were not automatically removed from the automatic reject list 38.

An automatic reject alarm threshold (ARAT) 46 can be programmed into the PIC 18 and enabled when or preferably prior to when the ACR 36 is enabled, to allow plant personnel to be warned when any one of the mold cavities is close to being automatically rejected by the PIC 18. The point at which the ARAT 46 is triggered preferably is determined by the programmed instructions input by plant personnel into the PIC 18. The programmed instructions direct the PIC 18 to recognize a programmed percentage of rejected containers from any one of the mold cavities, wherein the alarm threshold 46 is defined as a percentage of unacceptable containers in generally the same fashion as the "reject at" threshold 42, however the alarm threshold 46 is programmed as a percentage that is less than the "reject at" threshold 42. When the PIC 18 recognizes that the ARAT 46 has been reached, an alarm can be triggered via a signal from the PIC 18 to notify plant personnel that proactive measures may need to be taken in order to prevent the mold cavity from producing containers having unacceptable commercial variations in excess of the "reject at" threshold 42. Accordingly, the ARAT 46 is operable to send a signal to indicate when a mold of origin is producing a threshold number of containers approaching the programmed acceptable ART 40 limits, or the "reject at" threshold 42, and thus, can assist in preventing a mold cavity from being automatically rejected. As such, the ARAT 46 can assist in reducing the number of potential disruptions to container production from any one of the mold cavities. It should be recognized that the alarm can take the form of any number of notification mechanisms, such as visual, audible or tactile alarms, a flashing light, a flashing screen on the PIC 18, or other alerting mechanisms, as desired.

Desirably, when two or more inspection lines are being used, an inspection integrity check mechanism is incorporated within the system to ensure that one of the inspection lines 10, 12, 14 is not rejecting acceptable product from one of the mold cavities. The check mechanism is implemented by programming the PIC 18 to automatically compare the reject percentages for each mold cavity between the separate inspection lines 10, 12, 14. Desirably, the PIC 18 can be programmed to compare the threshold number of containers having been determined to have an unacceptable commercial variation from a specified mold cavity between the separate inspection lines. As such, the PIC can be programmed to alert plant personnel if any one of the inspection lines 10, 12, 14 is rejecting containers from a particular mold cavity in excess of a predetermined programmed percentage differential, referred to as an automatic reject difference threshold (ARDT) 48, over the remaining inspection lines. Accordingly, the ARDT 48 can be used to alert the plant personnel, preferably through a similar alarm mechanism as used for the ARAT 46, to a potential problem of one of the FP machines 34.

It should be recognized that upon reading the disclosure herein, one ordinarily skilled in the art of inspecting systems and methods used in the inspection of molded containers would readily recognize other embodiments than those disclosed herein, with those embodiments being within the scope of the claims that follow. For example, it should be recognized that any number of commercial variations may be checked in relation to a separate set of the programmed percentages discussed above, and that the commercial variations may be treated separately from one another. Additionally, any number of commercial variations may be inspected in combination with one another, such that the automatic rejection of a mold cavity, as discussed above, may be based on multiple commercial variations in relation to one another for a single container. Accordingly, this disclosure herein is intended to be exemplary, and not limiting. The scope of the invention is defined by the following claims.

The invention claimed is:

1. A method of inspecting and sorting molded containers, including the steps of:

a) inspecting molded containers for commercial variations outside of acceptable limits, which commercial variations are associated with mold cavities that produced the containers;

b) setting a cavity reject-at threshold in a controller for at least one unacceptable commercial variation and setting a cavity pack-at threshold in the controller that is less than said reject-at threshold;

c) correlating a container that is determined to have at least one unacceptable commercial variation with the mold cavity that produced the container;

d) segregating with a diverter all containers produced by the mold cavity after the mold cavity is determined to have produced a number of containers having said unacceptable commercial variation at or in excess of said reject-at threshold set forth in step b); and (e) allowing containers produced by a previously segregated mold cavity to proceed for further processing when a number of containers from said previously segregated mold cavity falls below said pack-at threshold set forth in step b).

2. The method set forth in claim 1 wherein step a) includes inspecting all containers in a production line and step d) includes removing the segregated containers from the production line.

3. The method set forth in claim 1 wherein step a) includes inspecting containers being conveyed along separate inspection lines and step d) includes comparing the number of containers having said unacceptable commercial variation from a specified mold cavity between said separate inspection lines.

4. The method set forth in claim 3 including providing an alarm indicative that one inspection line is segregating a threshold number of containers in excess of another inspection line.

5. The method set forth in claim 1 wherein step b) includes setting an alarm threshold that is less than said reject-at threshold for said at least one unacceptable commercial variation and step d) includes triggering an alarm when said alarm threshold is reached to assist in preventing the mold cavity from producing containers having unacceptable commercial variations in excess of said cavity reject-at threshold.

6. The method set forth in claim 1 wherein setting a cavity reject-at threshold for at least one unacceptable commercial variation includes setting at least one threshold for two or more unacceptable commercial variations.

7. The method set forth in claim 6 wherein said at least one threshold includes a separate threshold for each unacceptable commercial variation.

8. The method set forth in claim 6 wherein said at least one threshold is set as a function of two or more unacceptable commercial variations.

9. A system for inspecting and sorting molded containers, including:

an inspecting device that inspects containers for at least one commercial variation, which is associated with a mold of origin of the container, relative to predetermined acceptable limits for said at least one commercial variation to determine if a container has at least one commercial variation outside of said acceptable limits;

a container mold of origin identifier adapted to determine the mold of origin of a container determined by said inspection device to have at least one unacceptable commercial variation;

a controller communicating with the inspection device and the container mold of origin identifier, and operable to monitor at least one programmable reject-at threshold for at least one commercial variation to determine if a mold of origin has produced a number of containers having said at least one commercial variation outside of said acceptable limits and a pack-at threshold that is less than said reject-at threshold; and a diverter communicating with the controller and operable to segregate all containers produced by a mold of origin determined to have produced the number of containers having said at least one commercial variation beyond said acceptable limits at or in excess of said reject-at threshold, wherein the controller and diverter are operable to allow containers produced by a previously segregated mold cavity to proceed for further processing when a number of containers from said previously segregated mold cavity fall below said pack-at threshold.

10. The system of claim 9 wherein said controller is operable to send a signal to indicate when a mold of origin is producing a number of containers approaching said acceptable limits.

11. The system of claim 9 wherein said controller is operable to automatically allow containers from a previously rejected mold cavity to continue for further processing.

12. The system of claim 9 wherein said diverter removes all the containers produced by said mold of origin determined to have produced said number of containers having said at least one commercial variation beyond said acceptable limits.

13. The system of claim 12 wherein said controller is operable to automatically allow containers from a previously rejected mold cavity to continue for further processing.

14. A method of inspecting and sorting molded containers, including the steps of:

a) inspecting molded containers for commercial variations outside of acceptable limits, which commercial variations are associated with mold cavities that produced the containers;

b) setting a cavity reject-at threshold for at least two unacceptable commercial variations in a controller and setting a pack-at threshold that is less than said reject-at threshold for said at least two unacceptable commercial variations in the controller;

c) correlating a container that is determined to have at least one unacceptable commercial variation with the mold cavity that produced the container;

d) segregating with a diverter all containers produced by the mold cavity after the mold cavity is determined to have produced containers, which include said at least one unacceptable commercial variation, in excess of said reject-at threshold until a number of containers produced by a previously segregated mold cavity fall below said pack-at threshold for said at least one unacceptable commercial variation.

15. The method of claim 14 wherein said reject-at and said pack-at thresholds are each a ratio of unacceptable to acceptable containers.

* * * * *